US010125633B2

(12) United States Patent
Hãggmark

(10) Patent No.: US 10,125,633 B2
(45) Date of Patent: Nov. 13, 2018

(54) PART OF A CASING, ESPECIALLY OF A TURBO MACHINE

(75) Inventor: Anders Hãggmark, Finspong (SE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1509 days.

(21) Appl. No.: 13/264,003

(22) PCT Filed: Apr. 16, 2010

(86) PCT No.: PCT/EP2010/055057

§ 371 (c)(1),
(2), (4) Date: Oct. 12, 2011

(87) PCT Pub. No.: WO2010/119127

PCT Pub. Date: Oct. 21, 2010

(65) Prior Publication Data

US 2012/0034074 A1 Feb. 9, 2012

(30) Foreign Application Priority Data

Apr. 17, 2009 (EP) ..... 09005488

(51) Int. Cl.

| | |
|---|---|
| ***F01D 25/12*** | (2006.01) |
| ***F01D 25/14*** | (2006.01) |
| ***F01D 25/24*** | (2006.01) |
| ***F04D 29/52*** | (2006.01) |
| ***F04D 29/58*** | (2006.01) |
| ***F01D 25/26*** | (2006.01) |

(52) U.S. Cl.
CPC ..... *F01D 25/26* (2013.01); *F01D 25/14* (2013.01)

(58) Field of Classification Search
CPC ..... F01D 25/14; F01D 25/26
USPC ..... 415/115, 116, 117, 182.1, 177, 178, 180
See application file for complete search history.

(56) References Cited

U.S. PATENT DOCUMENTS

| | | | | |
|---|---|---|---|---|
| 2,896,906 | A * | 7/1959 | Durkin | 415/115 |
| 3,975,901 | A * | 8/1976 | Hallinger et al. | 60/786 |
| 4,214,851 | A * | 7/1980 | Tuley et al. | 415/115 |
| 5,127,794 | A | 7/1992 | Burge | |
| 5,980,201 | A * | 11/1999 | Benoist et al. | 415/115 |
| 6,216,438 | B1 | 4/2001 | Aschenbruck | |

(Continued)

FOREIGN PATENT DOCUMENTS

| | | |
|---|---|---|
| CN | 1294251 A | 5/2001 |
| CN | 1499042 A | 5/2004 |

(Continued)

*Primary Examiner* — Woody Lee, Jr.
*Assistant Examiner* — Brian O Peters

(57) ABSTRACT

A part of a casing of a turbomachine is provided. The part is of one piece of material. The part includes a cavity extending along a circumference of a rotational axis of the turbomachine, the cavity having a radially outer wall and a radially inner wall. The part also includes an inlet opening for supplying a cooling medium into the cavity and an outlet opening for discharging the cooling medium from the cavity. The radially inner wall is configured to support at least vanes or rotor seals facing rotor blades of the turbomachine, or a carrier for these vanes or seals. The proposed design provides enhanced efficiency without increasing production costs. The turbomachine may include, for example, a gas turbine, a steam turbine or a compressor.

16 Claims, 2 Drawing Sheets

(56) References Cited

U.S. PATENT DOCUMENTS

| | | | | |
|---|---|---|---|---|
| 6,227,798 | B1 | 5/2001 | Currin | |
| 6,427,448 | B1 * | 8/2002 | Reichert | 60/772 |
| 2011/0206502 | A1 * | 8/2011 | Rulli et al. | 415/177 |

FOREIGN PATENT DOCUMENTS

| | | | |
|---|---|---|---|
| CN | 1594845 | A | 3/2005 |
| DE | 3941174 | A1 | 7/1990 |
| EP | 0947669 | A2 | 10/1999 |
| EP | 1106787 | A2 | 6/2001 |
| EP | 0947669 | B1 | 5/2003 |
| GB | 2019500 | A | 10/1979 |
| JP | 660702 | U | 8/1994 |

* cited by examiner

PART OF A CASING, ESPECIALLY OF A TURBO MACHINE

CROSS REFERENCE TO RELATED APPLICATIONS

This application is the US National Stage of International Application No. PCT/EP2010/055057, filed Apr. 16, 2010 and claims the benefit thereof. The International Application claims the benefits of European application No. 09005488.3 filed Apr. 17, 2009. All of the applications are incorporated by reference herein in their entirety.

FIELD OF INVENTION

The invention relates to a part of a casing, especially a casing for a gas turbine, steam turbine or compressor, which is of one piece of material. Further the invention relates to a turbine or a compressor, especially a gas turbine comprising a casing, which comprises at least one incipiently mentioned part.

BACKGROUND OF INVENTION

Rotating equipment, especially gas turbines, steam turbines or compressors are often evaluated by their power output or intake, efficiency and production costs. In case of a gas turbine the ratio of the price to the power output is an important economic indicator for the customer. Considering the average lifetime and the fuel prices forecasted for the life time span simple mathematics allow first estimations, which assists a buyer's decision. From the supplier's perspective low production costs and high efficiency contravene each other considering most of the technical solutions to enhance efficiency.

One possibility of efficiency enhancement is proposed in DE 39 41 174 A1. The teaching of this disclosure is that a beneficial effect on efficiency can be achieved by a reduction of radial rotor clearance, which can be realised by cooling an inner casing, which is mounted in an outer casing by means of cool air, bled off from the compressor of the gas turbine. The cooling of the inner casing reduces the thermal expansion of this part and this shrinking reduces the radial clearance between stationary seals and rotating blades respectively stationary blades and rotating seals. Hence losses caused by secondary flows in the hot gas path of the gas turbine are reduced and the efficiency respectively the total power output can be increased.

However such a solution is expensive. Depending on the prices for fuel cheaper machines with a lower efficiency can better be put onto the market.

SUMMARY OF INVENTION

Therefore it is one object of the invention to increase the efficiency of a machine of the incipiently mentioned type without increasing the production costs significantly.

It is a further object to simplify machines of the incipiently mentioned type with a high efficiency to enhance availability.

Disclosed is a part of a casing, especially a casing for a turbine, preferably a gas turbine, a steam turbine or a compressor, which is of one piece of material, wherein the part comprises a cavity, which extends along a circumference of a rotational axis of a gas turbine, the steam turbine or the compressor, which cavity comprises a radially outer wall and a radially inner wall, an inlet opening for a supplying a cooling medium into the cavity, an outlet opening for discharging the cooling medium from the cavity, which radially inner wall is provided with means to support at least vanes or seals, which are facing rotor blades or a carrier for these vanes or seals.

A radially inner wall is considered a separation portion of the part of the casing according to the invention, which extends along an substantially smaller average radius with respect to the rotational axis than a radially outer wall. These walls follow in the second dimension of their extent substantially a circumferential path with respect to the rotational axis. The terms "axial", "radial", "circumferential" always refer to the rotational axis.

According to the invention the production costs are reduced by reduction of the number of parts since the casing is made as one piece of material. The benefit is not only the reduction of necessary storage capacity but also the decrease in complexity of the design and manufacture and assembly. Especially in the field of rotating equipment the rotor clearances must be set carefully to avoid any contact between moving and stationary parts considering also the transient conditions of start up and machine stop. The conventional connection and support of different casing parts relative to each other is also a delicate task, which increases costs significantly.

The total power output and efficiency is increased by the reduced blade tip clearance according to the invention since the inner part of the casing has a reduced temperature and therefore a reduced thermal expansion in relation to the expansion of the rotor especially in the radial direction.

A preferred embodiment of the invention provides an open-end of the cavity, which is located on one axial side of the cavity, where the radially inner wall and the radially outer wall are not connected by the one piece of material of the part. Such a design results in an essentially free end of the radially inner wall, and enables large radial movements of the radially inner wall carrying stationary parts, which face rotating parts, together forming a rotor seal.

The potential of radial displacement of stationary parts of a rotor seal with respect to the rotating parts can further be increased by locating the means to support the vanes or seals of the radially inner wall at the axialaxial half, which is proximate to the open-end of the cavity. This effect can further be increased, the longer the radially inner wall extends in an axial direction of the machine. For the same reason a ratio of the axial length to the radial range of the cavity at the respective largest dimension is bigger than 2.5.

While the double casing design with an inner hot and an outer cold casing has traditionally avoided problems of high stress by disconnecting the casings in a radial direction, the herewith proposed design preferably has geometrical optimized proportions, which are suited to fulfil mechanical integrity This optimisation goal can be achieved by providing the radially inner wall with a smaller radial thickness than the radially outer wall. Preferably the ratio of the radial thickness of the radially inner wall to the radially outer wall is between 0.3 to 0.8 at the respective locations of the thinnest wall thicknesses.

To obtain a reasonable cooling medium consumption and to restrict the cooling effect to the area, where the reduced thermal expansion alters the radial clearance, it is advantageous to provide the radially inner wall or the radially outer wall with means to mount a cover, which seals the open end of the cavity. This cover should be mounted to only one of the radial walls since the movement desired to change the radial clearance could otherwise be inhibited.

To obtain the highest economic benefit from the invention it is reasonable to produce the part as a cast piece.

The part is preferably made as a segment being part of the circumference of the casing.

A preferred field of application of the invention is the incorporation of the part into a gas turbine. Preferably two of the parts according to the invention are mounted together in a horizontal split plane, which split plane is close proximity or identical or/and parallel to the rotational axis of the gas turbine. However the part according to the invention can also be made as a barrel type part without a horizontal split plane of the casing, which enhances the mechanical integrity but might have disadvantages with respect to the assembly and design. The cavity integrated in the part according to the invention extends preferably, when the casing is completed, in the axial plane of the cavity over the whole circumference to obtain the desired clearance control uniformly over the whole circumference.

Preferably the cooling medium is air taken from a bleed of the compressor of the gas turbine in a sufficient mass flow to obtain the desired cooling effect.

A control valve in the line, which supplies the cooling medium, can be provided to adjust the cooling of the cavity and the from there resulting clearance reduction, which might be of significant benefit especially during transient operating conditions.

Another preferred embodiment provides a duct to at least one inner channel of a vane, which is connected to the outlet of the cavity to cool the vane by the cooling medium. Since cooling parts in the hot gas path of a gas turbine at least in the first stages of the power turbine behind a combustor is quite common in a modern high temperature and high efficiency gas turbine, the reduction of radial clearances by the use of the cooling medium respectively the air from a compressor bleed does not increase the cooling air consumption of a gas turbine significantly. According to this embodiment the whole amount of cooling air can also be used to cool these parts in the hot gas path.

With similar benefit the channels of the vane can be connected to a cooling medium supply device, which ejects the cooling medium in the direction of rotating parts to be cooled or a receiving device of the rotor, which supplies the same cooling medium to parts of the rotor in the hot gas path by means of a channel system. The vanes and the parts in the hot gas path, which are preferably rotor blades, can be provided with wholes in there surface connected to the cooling channels in these parts, to bleed of an amount of the cooling medium and to establish a cooling film on the surface of these parts in the hot gas a path in order to increase the maximum hot gas temperature of the gas turbine. The serial cooling order beginning with the cavity, which enables control of the radial clearances of the gas turbine and continuing with parts in the hot gas path leads to a very high cooling efficiency respectively to a low cooling air consumption.

BRIEF DESCRIPTION OF THE DRAWINGS

The above mentioned attributes and other features and advantages of this invention and the manner of attaining them will become more a parent and the invention itself will be better understood by reference to the following description of the currently best mode of carrying out the invention taken in conjunction with the accompanying drawing, wherein.

DETAILED DESCRIPTION OF INVENTION

Figure 1:
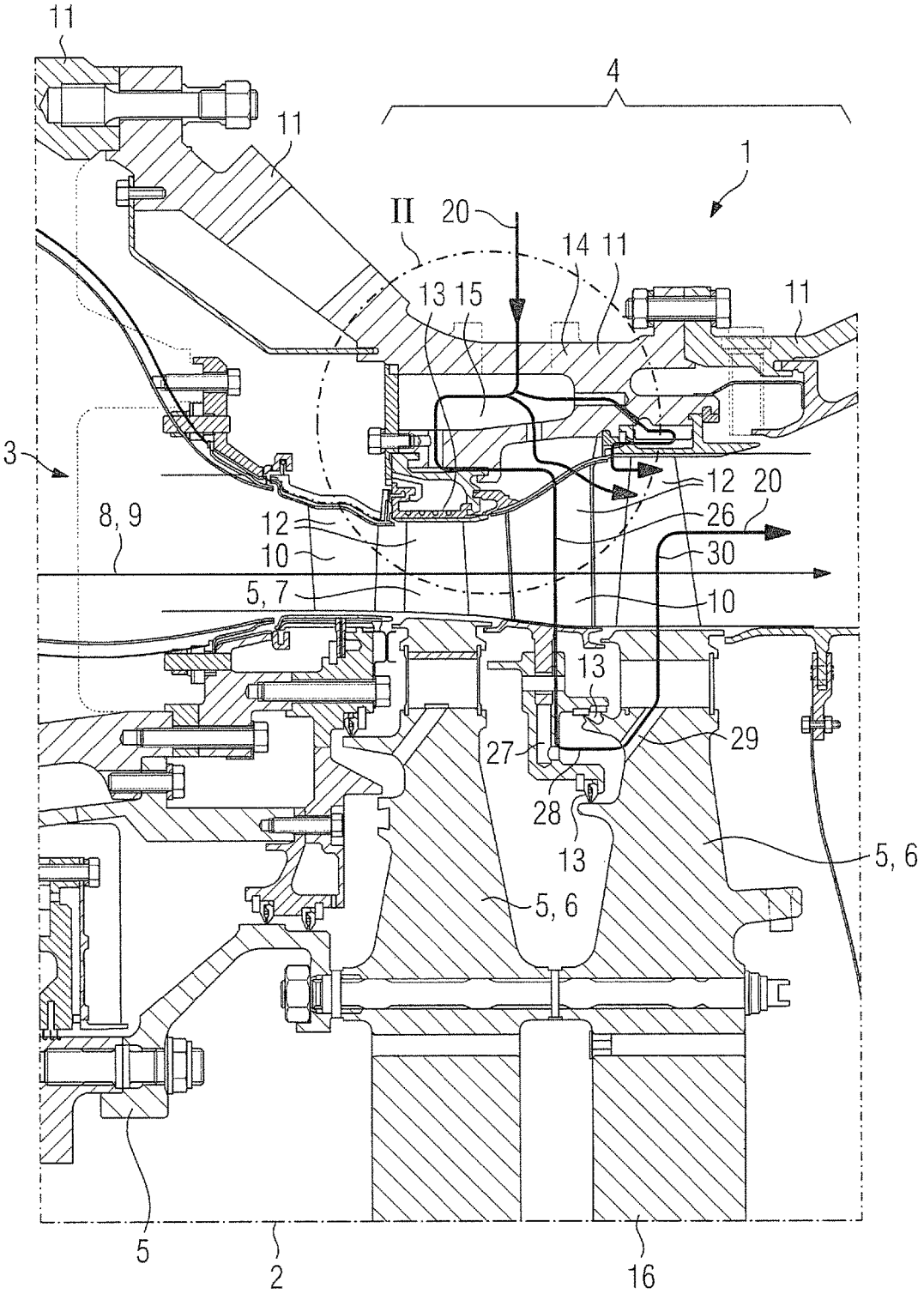
FIG. 1 shows a cross section in a longitude in a direction along the rotational axis of a gas turbine and FIG. 2 shows a detail indicated in FIG. 1 by roman numbering II.
Figure 2:
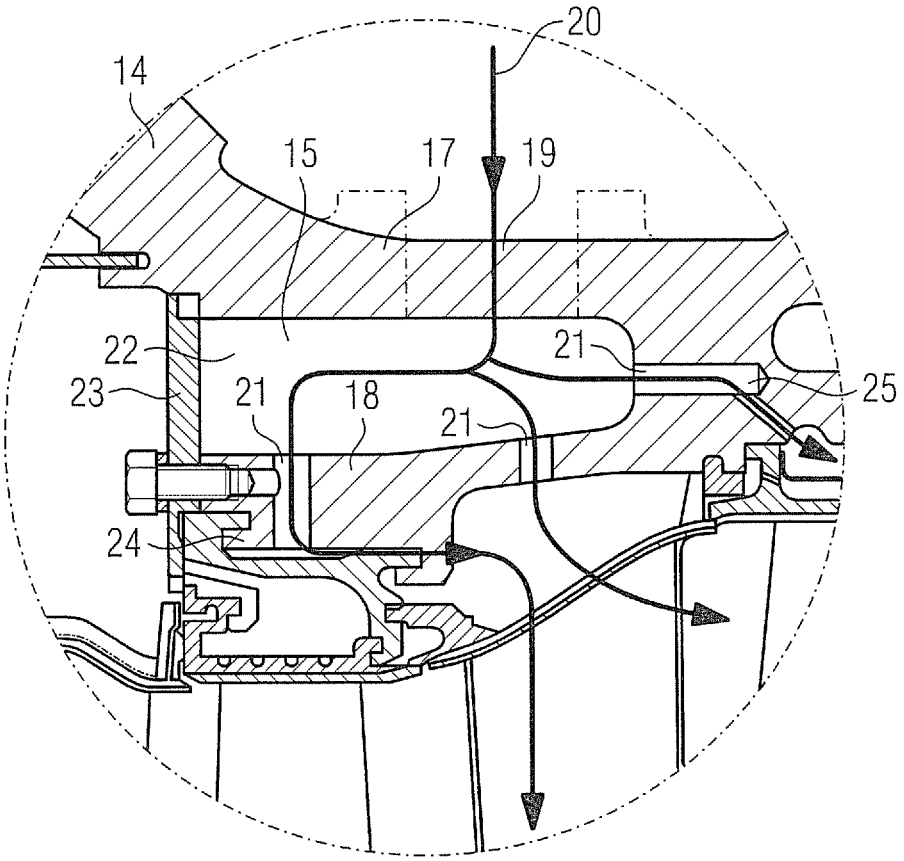

FIG. 1 shows an excerpt of a cross section through a gas turbine 1 along a rotational axis 2 depicting the exit of a combustor 3 and the first stages of a power turbine 4. FIG. 2 shows details of a turbine casing 11, which are important for the invention.

A rotor 5 extends along the rotational axis 2 comprising rotor disks 6, to which rotor blades 7 are mounted. A process gas, which is hot combustion gas 8 flows through the gas turbine 1 along a hot gas path 9, which is equipped with guide vanes 10 and the rotor blades 7. The hot combustion gas 8 can reach temperatures up to 2000° C. locally, which might exceed material properties of the components located in the hot gas path 9. The guide vanes 10 are static and mounted directly or indirectly to the casing 11. A pair of a plurality of guide vanes 10 and a plurality of rotor blades 7, each building a circumferential row of vanes respectively blades, form a turbine stage 12.

At an opposite end to their respective mounting to the casing or the rotor, the vanes respectively the blades are provided with a rotor seal 13 to avoid a bypass of the hot combustion gas past the respective vane or blade. These rotor seals 13 are of the labyrinth type and allow relative movement of the static and the rotating parts by a radial clearance. The efficiency of the gas turbine 1 is increased according to the invention by a controlled reduction of the radial clearance in the rotor seals 13.

The casing 11 comprises a part 14, which is provided with a cavity 15, which extends along the circumference of the rotational axis 2. The drawings only show one part 14, which is substantially identical to another part 14 of the casing 11 with respect to the features relevant for the invention, wherein the two parts 14 are joint together in a horizontal split plane 16, which extends along the rotational axis 2.

The cavity 15 comprises a radially outer wall 17 and a radially inner wall 18, which radially inner wall 18 is thinner than the radially outer wall 17. Both radial walls extend along a circumference. The cavity 15 is further provided with an inlet opening 19 for supplying a cooling medium 20 into the cavity 15 and an outlet opening 21 for discharging the cooling medium 20. The part 14 forms together with the radially outer wall 17 and the radially inner wall 18 one piece of material and is produced by casting. The cavity 15 comprises an axial open-end 22 (and the radially inner wall 18 is not connected with the radially outer wall 17 by the one piece of material of the part 14 at this open-end 22. This disconnection at the open end results in a quasi free end, which allows sufficient flexibility of the radially inner wall 18. The open-end 22 is sealed by a cover 23, which is mounted to one of the radially inner wall 18 or radially outer wall 17; in this example to the radially inner wall 18 was chosen. The cover 23 is basically a ring, which can be provided with a split in the horizontal split plane 16 for mounting purpose. The cover 23 allows relative movement of the radially inner wall 18 and the radially outer wall 17 due to its rigid connection to only one of them. When cooling medium 20 is supplied into the cavity 15 through the inlet opening 19 the thermal expansion especially of the radially inner wall 18 is reduced, which leads to a shrinking in the direction of the rotational axis 2. The clearances in the rotor seals 13 are reduced which leads to a lower leakage and increases the efficiency of the power turbine 4.

To enhance the clearance reducing effect, the ratio of the radial thicknesses of the radially inner wall 18 and the radially outer wall 17 is 0.65 at the respective locations of the thinnest wall thicknesses. Further the ratio of the axial length of the radial range of the cavity 15 at the respective largest dimension is bigger than 2.5, here 3.1. The radially inner wall 18 supports a rotor seal 13, sealing the radial gap to the rotor blade 7 of the first stage of the power turbine 4. This rotor seal 13 is mounted to the free end 24 of the radially inner wall 18. In general the means to support these rotor seals 13 or vanes 10 are located at the axial half of the radially inner wall 18, which is proximate to the open-end 22 of the cavity preferably.

The cooling medium 20, which is conventionally extracted from a not depicted compressor stage of the gas turbine 1, leaves the cavity 15 through the outlet and enters the vane 10 of the second stage of the power turbine 4. A smaller portion leaves the cavity 15 through a second outlet opening 25 to be ejected directly in the hot gas path 9 in front of the rotor blade 7 of the first stage for cooling purpose. The portion of the cooling medium 20, which is channeled into an inner channel 26 of the guide vane 10, cools the guide vane 10 and is subsequently led to a supply device 27. The supply device ejects a stream 28 of the cooling medium 20 into a receiving opening 29 provided at the rotor disk 6 of the downstream rotor blade 7. By a further channel system 13 the cooling medium 20 cools the rotor blade 7 and is finally ejected into the hot gas path 9 through openings in the blades surface. The ejected cooling medium 20 forms a cooling layer on the surface of the rotor blade 7.

The invention claimed is:

1. A part of a casing of a turbomachine, comprising:

a radially outer wall and a radially inner wall defining a cavity therebetween, the cavity extending along a circumference of a rotational axis of the turbomachine, and includes an open-end on one axial side of the cavity, an inlet opening for supplying a cooling medium into the cavity, an outlet opening for discharging the cooling medium from the cavity, wherein the radially inner wall is configured to support at least vanes or rotor seals facing rotor blades of the turbomachine, or a carrier for these vanes or seals, wherein the part is of one piece of material, and wherein the radially inner wall and the radially outer wall are not connected by the one piece of material at the open-end of the cavity.

2. The part according to claim 1, wherein the radially inner wall is provided with a means for supporting at least vanes or rotor seals facing rotor blades of the turbomachine, or a carrier for these vanes or seals, the means for supporting being located at an axial half of the radially inner wall, which is proximate to the open-end of the cavity.

3. The part according to claim 1, wherein the radially inner wall has a smaller radial thickness than the radially outer wall.

4. The part according to claim 3, wherein the ratio of the radial thickness of the radially inner wall to that of the radially outer wall is between 0.3 to 0.8 at the respective locations of the thinnest wall thicknesses.

5. The part according to claim 1, wherein the radially inner wall or the radially outer wall are configured to mount a cover, which seals an open-end of the cavity.

6. The part according to claim 1, wherein the part is a cast piece.

7. The part according to claim 1, wherein the turbomachine is selected from a gas turbine, a steam turbine and a compressor.

8. A turbine, comprising:

a casing having a part which is of one piece of material, wherein the part includes:

a radially outer wall and a radially inner wall defining a cavity therebetween, the cavity extending along a circumference of a rotational axis of the turbine, and includes an open-end on one axial side of the cavity, an inlet opening for supplying a cooling medium into the cavity, an outlet opening for discharging the cooling medium from the cavity, wherein the radially inner wall is configured to support at least vanes or rotor seals facing rotor blades of the turbine, or a carrier for these vanes or seals, and wherein the radially outer wall and the radially inner wall are not connected by the one piece of material at the open-end of the cavity.

9. The turbine according to claim 8, wherein the turbine is a power turbine, wherein the radially inner wall is configured to support at least vanes or rotor seals facing rotor blades of a first stage of the power turbine.

10. The turbine according to claim 8, wherein the casing is provided with a split plane.

11. The turbine according to claim 8, wherein the cavity extends over the whole of the circumference.

12. The turbine according to claim 8, wherein the cooling medium is taken as air from a bleed off of a compressor of a gas turbine.

13. The turbine according to claim 8, wherein a duct to at least one inner channel of a vane is connected to the outlet of the cavity to cool the vane by the cooling medium.

14. The turbine according to claim 13, wherein the at least one inner channel of the vane is connected to a cooling medium supply device that ejects the cooling medium into a receiving device provided at the rotor, the cooling medium being supplied into a rotor cooling channel system.

15. The turbine according to claim 14, wherein the vane and/or the rotor cooling channel system is/are provided with holes through which the cooling medium is ejected into a hot gas path of the turbine to establish a cooling film layer on the vane respectively the part of the rotor.

16. The turbine according to claim 8, wherein the turbine is a gas turbine.

* * * * *